US010835913B2

(12) United States Patent
Mispel-Beyer

(10) Patent No.: US 10,835,913 B2
(45) Date of Patent: Nov. 17, 2020

(54) REFILLABLE VERTICAL FOREGRIP SPRAY DEVICE

(71) Applicant: Jens Martin Mispel-Beyer, Tottenham (CA)

(72) Inventor: Jens Martin Mispel-Beyer, Tottenham (CA)

(73) Assignee: Jens Martin Mispel-Beyer, Tottenham (CA)

( * ) Notice: Subject to any disclaimer, the term of this patent is extended or adjusted under 35 U.S.C. 154(b) by 97 days.

(21) Appl. No.: 15/945,247

(22) Filed: Apr. 4, 2018

(65) Prior Publication Data

US 2019/0308213 A1 Oct. 10, 2019

(51) Int. Cl.

| | |
|---|---|
| ***B05B 15/00*** | (2018.01) |
| ***B05B 15/62*** | (2018.01) |
| ***F41C 23/16*** | (2006.01) |
| ***F41H 9/10*** | (2006.01) |
| ***B05B 15/63*** | (2018.01) |
| ***B05B 11/00*** | (2006.01) |
| ***B05B 1/06*** | (2006.01) |
| ***B05B 12/00*** | (2018.01) |

(52) U.S. Cl.

CPC ..... *B05B 15/62* (2018.02); *B05B 1/06* (2013.01); *B05B 11/0037* (2013.01); *B05B 11/0089* (2013.01); *B05B 12/0026* (2018.08); *B05B 15/63* (2018.02); *F41C 23/16* (2013.01); *F41H 9/10* (2013.01)

(58) Field of Classification Search

CPC ..... B05B 1/06; B05B 7/2467; B05B 9/04; B05B 11/0073; B05B 11/0089; B05B 12/0026; B05B 15/62; B05B 15/63; F41C 23/26; F41H 9/10

USPC ..... 239/337, 373, 526, 573

See application file for complete search history.

(56) References Cited

U.S. PATENT DOCUMENTS

| | | | | |
|---|---|---|---|---|
| 2,512,105 A * | 6/1950 | Van Marwijk Kooij | ..... | B65D 11/06 222/323 |
| 3,327,907 A * | 6/1967 | Meyers | ..... | B65D 83/38 222/402.16 |
| 3,559,701 A * | 2/1971 | Wittersheim | ..... | B65D 83/14 141/20 |
| 3,613,960 A * | 10/1971 | Beard | ..... | B65D 83/42 222/330 |
| 3,974,945 A * | 8/1976 | Burger | ..... | B65D 83/62 222/192 |
| 4,186,851 A * | 2/1980 | Cantor | ..... | F21V 33/0076 222/113 |
| 4,475,667 A * | 10/1984 | Ori | ..... | B65D 83/36 222/39 |
| 5,397,029 A * | 3/1995 | West | ..... | B65D 83/202 222/79 |

(Continued)

*Primary Examiner* — Viet Le

(57) ABSTRACT

A refillable vertical foregrip spray device. The device has a weapon mounting interface (M LOK, Keymod, Picatinny) integral to the valve block. The hollow cylindrical portion contains the pressurized liquid or gaseous contents of the operator's choice. The valve block houses a push button release valve with a sliding safety mechanism and a charge valve for pressurizing the device. The weapon mounting interface is integral to the valve block. The device does not require the use of disposable aerosol containers. When not weapon mounted the device can also be freely carried and the user can effectively dispense liquid or gaseous contents of their choice.

6 Claims, 15 Drawing Sheets

(56) References Cited

U.S. PATENT DOCUMENTS 5,509,581 A * 4/1996 Parsons ..... F41H 9/10 222/153.13
5,570,817 A * 11/1996 Anderson ..... F41H 9/10 222/153.11
5,649,723 A * 7/1997 Larsson ..... F16L 37/1215 285/322
5,671,559 A * 9/1997 Ludaesher ..... F41B 9/00 222/79
5,673,819 A * 10/1997 Brunswig ..... F21V 33/0064 222/113
5,709,320 A * 1/1998 Jimenez ..... B05B 11/00 222/153.13
5,787,628 A * 8/1998 Teetzel ..... F41H 9/10 222/79
5,795,054 A * 8/1998 Booty, Jr. ..... F41H 9/10 222/162
5,839,624 A * 11/1998 Parsons ..... B65D 83/36 222/402.19
5,842,602 A * 12/1998 Pierpoint ..... F41H 9/10 222/1
5,983,548 A * 11/1999 Ludaescher ..... F41H 9/10 42/1.08
6,003,547 A * 12/1999 Tippmann, Jr. ..... F16K 24/04 137/588
6,052,051 A * 4/2000 Whalen ..... F41H 9/10 222/1
6,158,482 A * 12/2000 Rubin ..... F17C 5/02 141/197
6,196,419 B1 * 3/2001 Haney ..... B65D 83/202 222/153.03
6,199,726 B1 * 3/2001 Cardwell, III ..... F41H 9/10 222/183
6,546,661 B1 * 4/2003 Staubs ..... F41H 9/10 102/367
6,929,154 B2 * 8/2005 Grey ..... A61M 15/009 222/153.03
6,955,194 B2 * 10/2005 MacNeal ..... F16L 29/02 141/18
7,121,432 B2 * 10/2006 Kostal ..... F41H 9/10 222/192
7,360,914 B2 * 4/2008 Kim ..... F21V 33/0064 362/109
7,387,140 B2 * 6/2008 Brunn ..... F16J 12/00 141/18
7,490,864 B2 * 2/2009 Cheng ..... F16L 37/0847 137/614.05
7,686,189 B2 * 3/2010 Althoff ..... A45D 34/04 222/153.11
7,967,035 B2 * 6/2011 Brunn ..... F16J 12/00 141/20
8,074,847 B2 * 12/2011 Smith ..... B65D 83/38 222/394
8,356,614 B2 * 1/2013 Forrester ..... A45B 3/14 135/66
9,170,073 B2 * 10/2015 Mangold ..... F41C 27/00
9,423,208 B1 * 8/2016 Mahmalji ..... F41C 23/16
10,197,358 B2 * 2/2019 Hebden ..... F41C 23/22
10,254,089 B2 * 4/2019 Gosson ..... F41H 9/10
2004/0137988 A1 * 7/2004 Parsons ..... F41H 9/10 463/47.2
2007/0194048 A1 * 8/2007 Teig ..... F21V 33/0076 222/113
2008/0020794 A1 * 1/2008 Garon ..... A61B 5/14532 455/556.1
2008/0163954 A1 * 7/2008 Brunn ..... F16J 12/00 141/3
2011/0047851 A1 * 3/2011 Mock ..... F41C 23/16 42/72
2011/0210146 A1 * 9/2011 Dapper ..... F41H 9/10 222/113
2011/0240675 A1 * 10/2011 McDoanald ..... B05B 15/62 222/180
2011/0240676 A1 * 10/2011 McDonald ..... B05B 11/04 222/211
2012/0272557 A1 * 11/2012 Yan ..... F41C 23/12 42/69.01
2013/0105518 A1 * 5/2013 McPherson ..... F41H 9/10 222/153.11
2014/0048561 A1 * 2/2014 Mangold ..... F41H 9/10 222/153.11
2014/0182182 A1 * 7/2014 Adcock, Jr. ..... A01G 22/00 42/72
2014/0204513 A1 * 7/2014 Del Padre ..... H04M 1/21 361/679.01
2014/0252028 A1 * 9/2014 Lord ..... F41H 9/10 222/79
2014/0360079 A1 * 12/2014 Iannello ..... F41G 11/003 42/90
2015/0121737 A1 * 5/2015 Anderson ..... F41C 23/16 42/72
2015/0300775 A1 * 10/2015 Combs ..... F41C 23/16 42/72
2015/0312399 A1 * 10/2015 Teig ..... H04W 4/90 455/404.2
2017/0173616 A1 * 6/2017 Rocca ..... A45C 11/00
2018/0037398 A1 * 2/2018 Shlaferman ..... B65D 83/205
2018/0051963 A1 * 2/2018 Kushneryk ..... F41H 9/10
2018/0051964 A1 * 2/2018 Forsythe ..... B05B 9/0861
2018/0216909 A1 * 8/2018 Thomann ..... F41H 9/10
2019/0310049 A1 * 10/2019 Stilson ..... F41H 9/10

* cited by examiner

REFILLABLE VERTICAL FOREGRIP SPRAY DEVICE

CROSS-REFERENCE TO RELATED APPLICATIONS

This application claims the benefits of U.S. Provisional Patent Application No. 62/487,897 filed Apr. 20, 2017, the disclosure of which is hereby incorporated by reference in its entirety including all figures, tables and drawings.

STATEMENT REGARDING FEDERALLY SPONSORED RESEARCH OR DEVELOPMENT

Not applicable

REFERENCE TO SEQUENCE LISTING, A TABLE, OR A COMPUTER PROGRAM LISTING COMPACT DISC APPENDIX

Not applicable

BACKGROUND OF THE INVENTION

Judging from the number of past inventions relating to a device giving a user the ability to spray a non-lethal liquid (generally a pepper spray type chemical irritant) from a lethal weapon, it is well known that there is a demand from first responders, hunters, and civilians concerned with personal defense to have this ability. The ability to switch between lethal and non-lethal force in a split second is very important to all that might find themselves in a situation requiring this crucial ability. The quicker, more ergonomic and intuitive, the more effectively a user can transition between lethality's. By incorporating the ability to spray from a vertical foregrip it provides the user this ability contained in familiar weapon attachment.

Current designs rely on the use of aerosol canisters. This limits the user to what is available in pre-filled canisters. Many users will require a certain amount of training to familiarize themselves with the performance characteristics of the aerosol canister and how it dispenses from its related device. This can become quite costly and many users will forgo the proper amount of training to keep costs to a minimum. Current designs also do not perform well when removed from a weapon mounting system, limiting usefulness.

It is therefore the primary objective and novelty of the invention to relive the user of the short comings of current designs. The invention builds on the popular attributes of the vertical foregrip and gives the user many new, novel and unique features not available until now.

Important aspects of the invention are numerous. The ability for the user to select the media that best suits their anticipated needs is very important. A first responder might require a powerful chemical irritant to subdue an unarmed but dangerous suspect. A deer hunter might choose to fill the device with a liquid animal attractant to spray strategically while hunting. A camper might find it useful to fill the device with lighter fluid and independently carry the device to assist with starting fires for cooking on their camping trip and when they return home, switch the contents to pepper spray and re-mount it to their home defense weapon. The possibilities are endless when the user is freed from confines of an aerosol canister.

Another unique quality of the invention is the ability for the user to train with the device whenever they desire with no added costs or inconvenient trips to a store to purchase refill aerosol canisters. The device can be easily emptied and refilled making for quick and easy transitions to different contents or effortless training sessions.

Further novel qualities of the invention include the ability to function and fulfill its desired role equally well, mounted or unmounted from a weapon. This is due to an ergonomic sliding safety actuator positioned next to the push button release valve. Aerosol based designs are unable to offer such a compact design due to the fact that the aerosol canister body must be moved or the tip depressed. The shape and size of aerosol canisters do not lend themselves to good ergonomics. This invention utilizes a micro push button release valve that can be positioned in ergonomically ideal places. The safety actuator is simply disengaged by a short shift of ones thumb. The user can then immediately push the button to release the pressurized contents of the device. No aerosol based device offers such ease of operation.

BACKGROUND ART

The prior art listed below did not disclose patents that possess any of the novelty of the instant invention; however the following U.S. patents are considered related:

Patent Number Inventor Issue Date

U.S. Pat. No. 9,423,208 B1 Mahmalji Aug. 23, 2016
U.S. Pat. No. 9,170,073 B2 Mangold Oct. 27, 2015
U.S. Pat. No. 7,644,839 B2 McNulty, Jr. Jan. 12, 2010
2006/0120009 A1 Chudy, II Jun. 8, 2006
U.S. Pat. No. 6,658,779 B2 Bauer et al. Dec. 9, 2003
U.S. Pat. No. 6,546,661 B1 Staubs Apr. 15, 2003
U.S. Pat. No. 5,983,548 Lidaescher Nov. 16, 1999
U.S. Pat. No. 5,787,628 Teetzel Aug. 4, 1998

BRIEF SUMMARY OF THE INVENTION

The Refillable Vertical Foregrip Spray Device in the preferred embodiment comprises two main components, the Valve Block and the Hollow Cylindrical Portion. Part of the MLOK weapon mounting interface is integrally formed on top of the Valve Block allowing the device to be mounted to a weapon. Alternatively "Keymod" or "Picatinny" weapon mounting interfaces can be used with equal utility. The device is refillable and does not require the use of aerosol canisters. Not requiring the use of aerosol canisters allows the user to fill the device with fluid and or gaseous contents that suit the operator's anticipated needs. The contents are stored in the vertical grip portion known as the Hollow Cylindrical Portion. The device is designed to have a long lifespan and rarely require replacing as expiry date bound aerosol based products do. The device fulfils its role equally well mounted or unmounted from a weapon.

DETAILED DESCRIPTION OF THE INVENTION

The best mode for carrying out the invention is presented in terms of a preferred embodiment. This preferred embodiment is shown in figures (FIGS. 1 through 16 and is comprised of a Valve Block 1 mated to a Hollow Cylindrical Portion 28 providing a Vertical Gripping Surface 29 for an operator and storing, under pressure, the contents to be sprayed. Housed in the Valve Block 1, a Sliding Safety 21 engages with the Push Button Release Valve 8 to prevent an accidental release of the contents. When made operable, the Push Button Release Valve 8 allows the operator to precisely dispense the contents contained in the Hollow Cylindrical Portion 28. Similarly housed in the Valve Block 1 is a Charge Valve 4. The Charge Valve 4 enables the operator to pressurize the device. The Hollow Cylindrical Portion 28 and the Valve Block 1 are made of materials such as aluminum, steel or reinforced polymers, however other materials suitable for the purpose may be used with equal utility.

The Valve Block 1 includes Internal Conduit A 6 and Internal Conduit B 9 for directing the flow of the outgoing contents and facilitating the filling and pressurization of the device. The down facing portion of the Internal Conduits A&B 6&9 are situated in a manner as to be centralized in the Mating Cavity 27. This ensures incoming and outgoing fluids and gases can enter or exit the Hollow Cylindrical Portion 28 without interfering with the mating the of Hollow Cylindrical Portion 28 to the Valve Block 1. Internal Conduit A 6 connects with the Charge Valve Cavity 3. Internal Conduit B 9 connects with the Push Button Release Valve Cavity 7. The down facing side of Internal Conduit B 9 connects with the Pickup Tube Cavity 10.

Integral to the Valve Block 1 and the rifle or weapon is a MLOK Weapon Mounting Interface 16. The MLOK Weapon Mounting Interface 16 comprises MLOK slots on the rifle or weapon and the associated parts of the device. In the preferred embodiment an MLOK interface is depicted. Picatinny or Keymod interfaces may also be integrally designed or mounted to the Valve Block 1 instead of MLOK. Any future weapon mounting systems can be integrally designed or mounted to the Valve Block 1. The MLOK Weapon Mounting Interface 16 also comprises two Mounting Screw Holes 17 passing through the Valve Block 1 and Locating Bosses 18 formed on top of the Valve Block 1. Securing the device to the rifle or weapon are two Mounting Screws 31 and two MOLK Nuts 30.

In the preferred embodiment a Dovetail 12 is formed in the Valve Block 1 facing the operator. The Dovetail 12 houses the Sliding Safety 21. The Sliding Safety 21 is secured by a Detent 15 and Spring 14. The Detent 15 and Spring 14 limit the travel of the Sliding Safety 21. A Detent Cavity 13 is formed in the Valve Block 1 centralized in the Dovetail 12. The Detent Cavity 13 houses the Detent 15 and Spring 14. On either side of the Detent Cavity 13 two round Recessed Impressions 25 are formed into the Valve Block 1. These allow for the containment of contrasting colored paint to give a visual indication of the Sliding Safety's 21 position to the operator.

The Sliding Safety 21 can engage with the Push Button Release Valve 8 to prevent accidental operation. The Sliding Safety 21 has a Raised Thumb Grip 26 facing the operator. The other side of the Sliding Safety 21 has a Detent Channel 23. The Detent Channel 23 has Detent Engagement Holes 24 at either end. Formed in the Sliding Safety 21 at the end that engages with the Push Button Release Valve 8 are the Arrest Prongs 22. When the Sliding Safety 21 is engaged to be in safe mode, the Arrest Prongs 22 slide under a portion of the Push Button Release Valve 8 to deactivate it.

The Push Button Release Valve 8 is housed in the Push Button Release Valve Cavity 7. The Push Button Release Valve Cavity 7 is formed in the Valve Block 1 in a manner that positions it to intersect with Internal Conduit B 9 and the Nozzle 2. The Push Button Release Valve 8 is secured in place by a Set Screw 20. The Set Screw 20 enters the Valve Block 1 through the Set Screw Hole 19 and contacts the Push Button Release Valve 8 holding it firmly in position. A push button style valve is used in the preferred embodiment however toggle or ball top or other valves suitable for the purpose may be used with equal utility.

The Nozzle 2 is a hole in the Valve Block 1 facing away from the operator. This hole needs to intersect with the Push Button Release Valve Cavity 7. The Nozzles 2 shape and diameter can be varied to change the spray pattern, pressure and volume. There can be more than one nozzle formed in the Valve Block 1 if desired.

The Charge Valve 4 is housed in the Valve Block 1 facing away from the operator. The Charge Valve Cavity 3 must be positioned to intersect with Internal Conduit A 6. The Charge Valve 4 Threads into the Charge Valve Cavity 3 and seals with an O-ring. The Charge Valve 4 is fitted with a Schrader valve and can be filled by connecting a compatible pressurized gas/air filling system. The Charge Valve Cap 5 keeps the Charge Valve 4 clean from debris. However other valves suitable for the purpose may be used with equal utility.

The Pickup Tube 11 mates into the Pickup Tube Cavity 10. The Pickup Tube Cavity 10 must intersect with Internal Conduit B 9. When the device is assembled the Pickup Tube 11 extends to the bottom the Hollow Cylindrical Portion 28. This ensures that fluid contents are drawn out of the Hollow Cylindrical Portion 28 once the Push Button Release Valve 8 is depressed. The Pickup Tube 11 is made of a material such as aluminum, steel or plastic, however other materials suitable for the purpose may be used with equal utility.

The Hollow Cylindrical Portion 28 is a pressurized chamber able to contain fluids or gases under enough pressure to propel the contents up the Pickup Tube 11, through Internal Conduit B 9, through the Push Button Release Valve 8 and out the nozzle 2 as the operator commands. The Hollow Cylindrical Portion 28 has a Vertical Gripping Surface 29 with recessed grooves formed into the outer wall. The sections between the recessed grooves are knurled. The grooves and knurling provide the operator with a secure grip. The Hollow Cylindrical Portion 28 will work regardless of the presence of a textured surface. The base of the Hollow Cylindrical Portion 28 is formed to a point. This works as a force multiplier if the operator uses the device as a striking weapon. Other embodiments could include a glass breaking tip on the base of the Hollow Cylindrical Portion 28. Further embodiments could be constructed to have different length and diameter cylindrical portions as operator needs dictate.

The term "mating" shall mean joining two parts by forming threads to adjoining parts, interference fitting and or using anaerobic adhesives, however other forms of joining two parts suitable for the purpose may be used with equal utility.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

DETAILED DESCRIPTION OF OTHER PREFERRED EMBODIMENTS

Other preferred embodiments will not be weapon mountable. The design will change in ways that suit the other embodiment but most parts will stay the same, interact the same, be constructed of the same materials and fulfill the role of spraying the same. I will attempt to highlight only the differences between the two embodiments. Figures (FIG. 17 through 25 depict another preferred embodiment.

The Valve Block 1 in this embodiment is smaller and does not contain a weapon mounting interface or a Charge Valve 4. A significant feature of the Valve Block 1 is dual nozzles comprised of Nozzle A 34 and Nozzle B 35. This provides a simultaneous spray when the operator depresses the Push Button Release Valve 8. The simultaneous spray will provide better coverage on the operators intended target.

The Charge Valve 4 has been moved to the bottom of the Hollow Cylindrical Portion 28. Instead of a mating cavity this embodiment uses a Mating Protrusion 33 to mate with the Hollow Cylindrical Portion 28. Another important change can be found in the Sliding Safety 21. Instead of arrest prongs this embodiment employs a Key Hole 32 design. It achieves its role of deactivating the Push Button Release Valve 8 by the smaller radius of the Key Hole 32 sliding under a portion of the Push Button Release Valve 8 preventing it from being operated.

Unique to this embodiment is that the top of the Valve Block 1 is angled. Nozzle A 34 and Nozzle B 35 are also formed at the same angle. One should note that when the operator uses this embodiment the angled top should point in the direction of the intended target. This method takes advantage of ones extended arm and the natural grip ones hand will have on the device. This is modeled after the angled grip on modern pistols. The ergonomics of this embodiment are superior to other competing devices sold in the defensive spray marketplace.

The term "mating" shall mean joining two parts by forming threads to adjoining parts, interference fitting and or using anaerobic adhesives, however other forms of joining two parts suitable for the purpose may be used with equal utility.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

Figure 1:
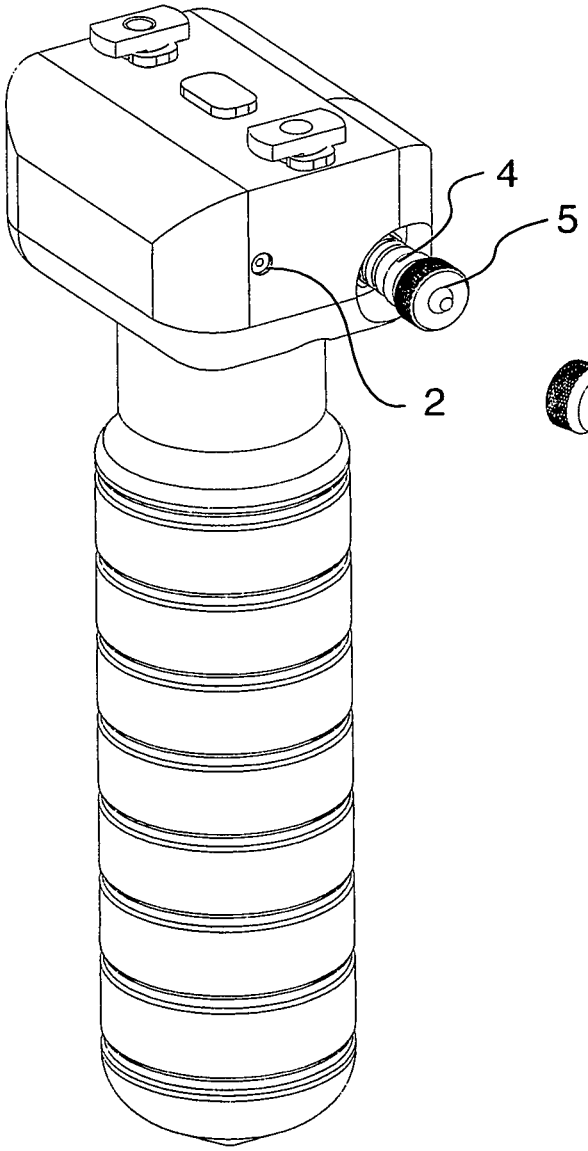
FIG. 1 is a top right/front view of the refillable vertical foregrip spray device in the preferred embodiment.
Figure 2:
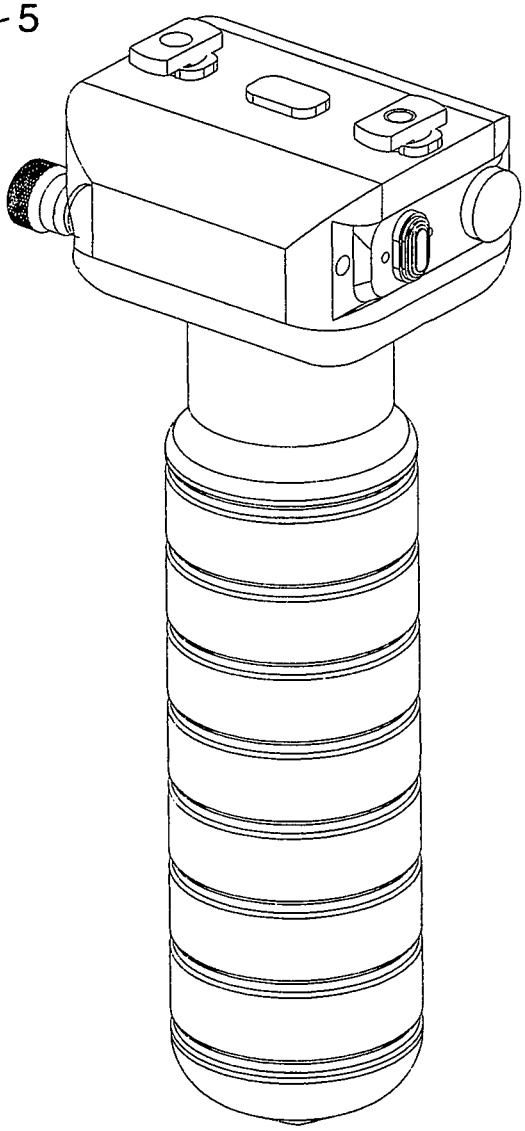
FIG. 2 is a top left/rear view of the refillable vertical foregrip spray device in the preferred embodiment.
Figure 3:
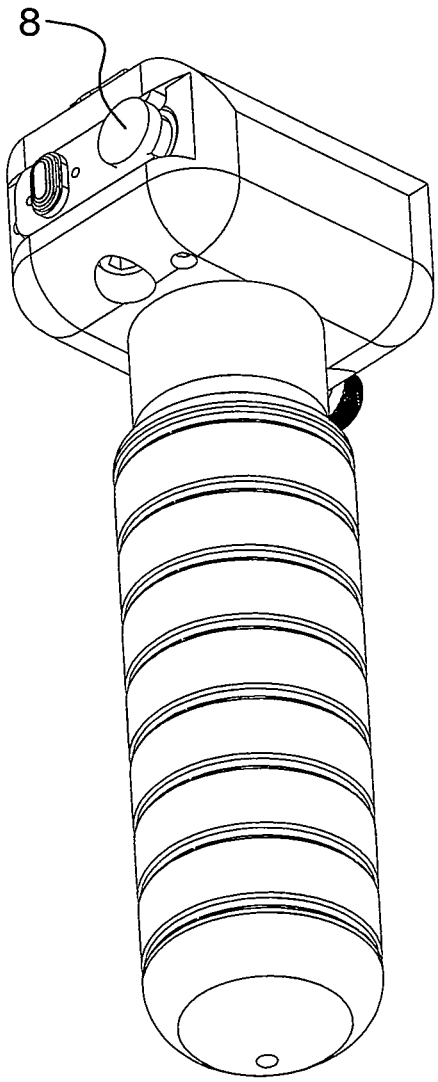
FIG. 3 is a bottom right/rear view of the refillable vertical foregrip spray device in the preferred embodiment.
Figure 4:
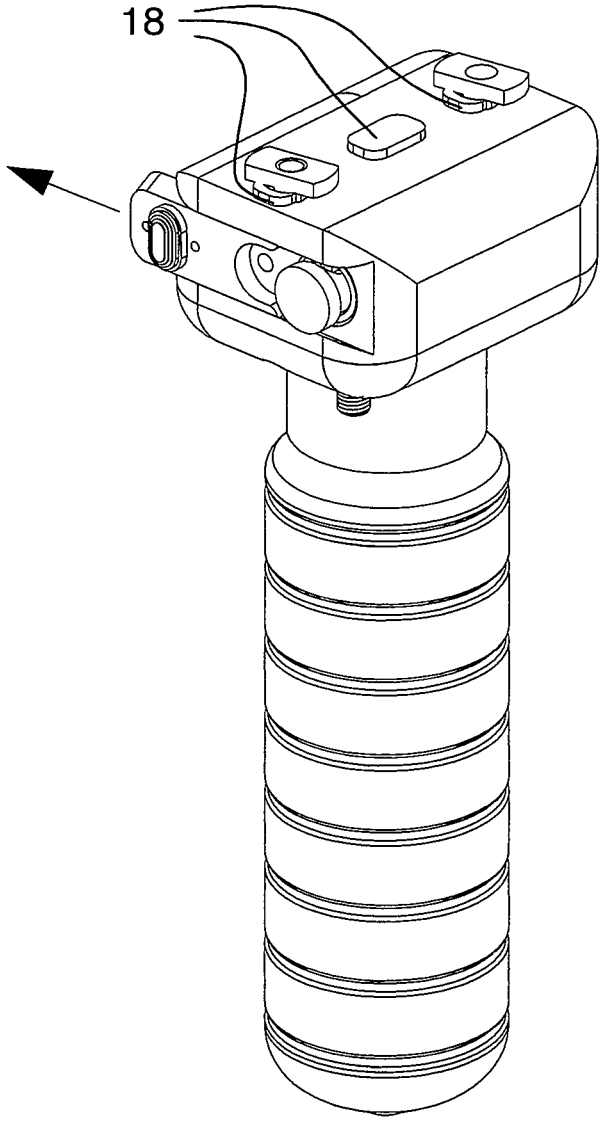
FIG. 4 is a top right/rear view of the refillable vertical foregrip spray device in the preferred embodiment.
Figure 5:
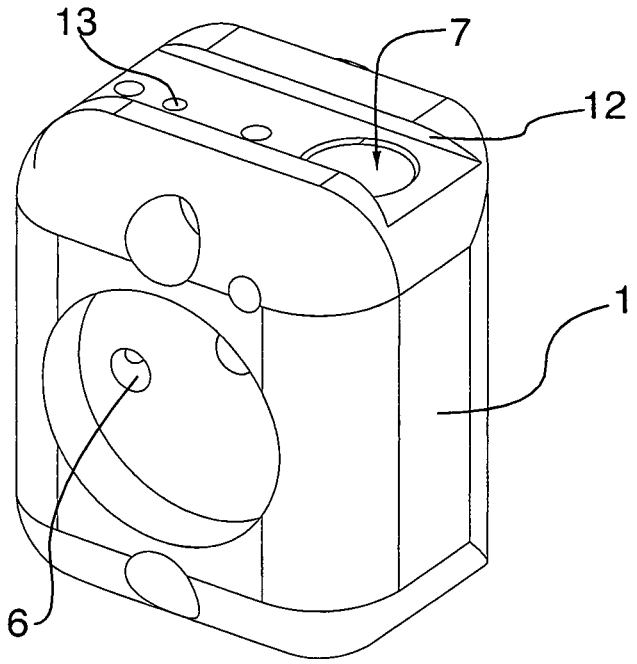
FIG. 5 is a bottom/rear view of the valve block in the preferred embodiment.
Figure 6:
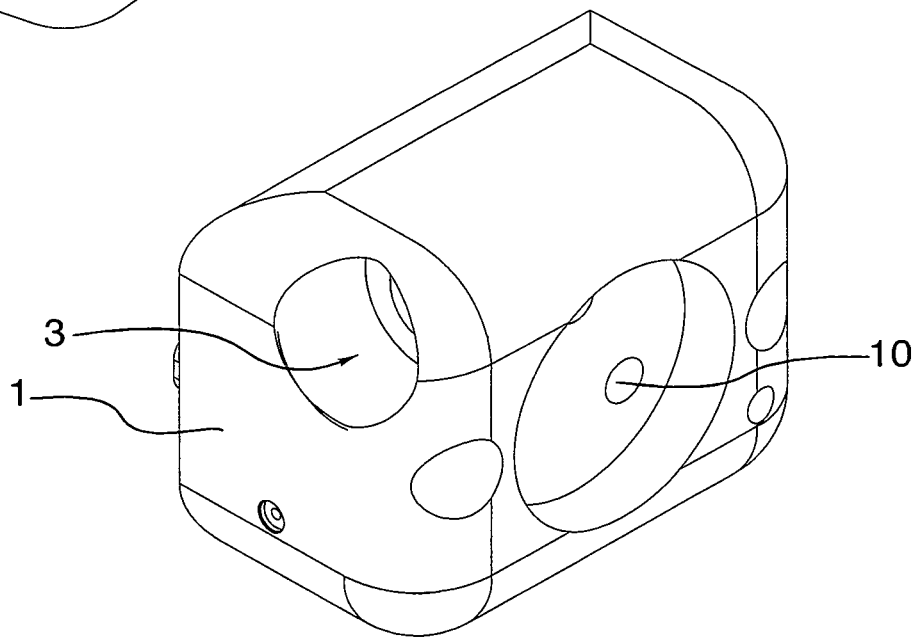
FIG. 6 is a bottom/front view of the valve block in the preferred embodiment.
Figure 7:
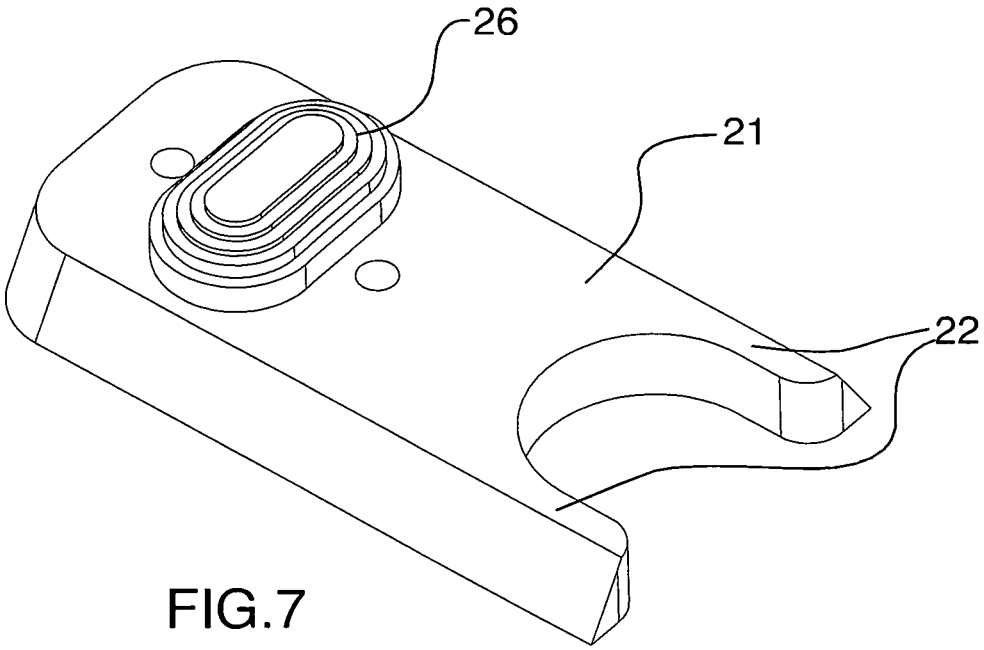
FIG. 7 is a front/lower side view of the sliding safety in the preferred embodiment.
Figure 8:
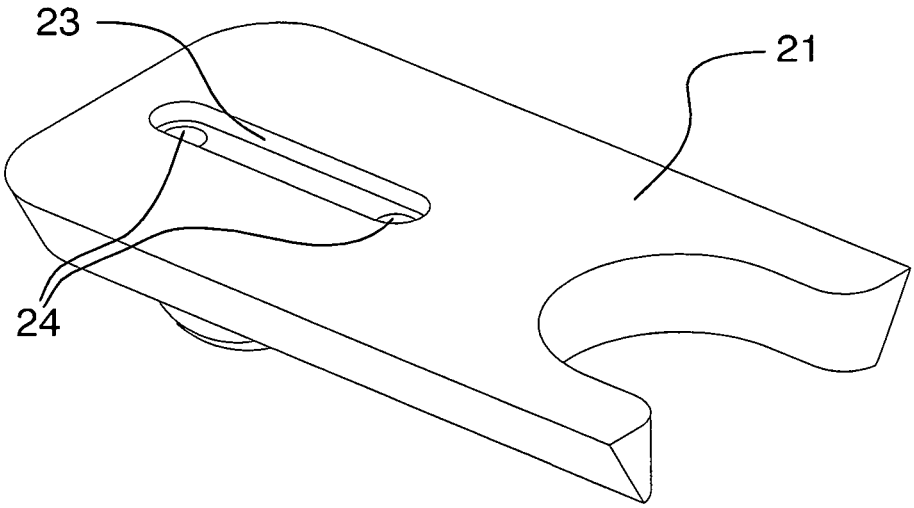
FIG. 8 is a rear/upper side view of the sliding safety in the preferred embodiment.
Figure 9:
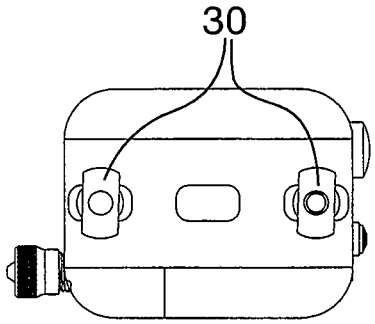
FIG. 9 is a top view of the refillable vertical foregrip spray device in the preferred embodiment.
Figure 10:
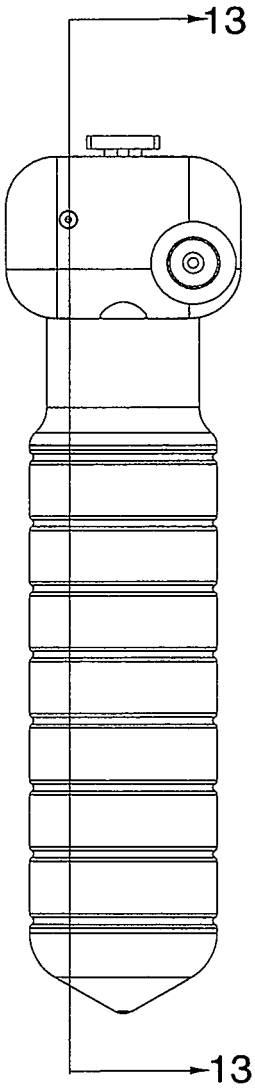
FIG. 10 is a front view of refillable vertical foregrip spray device in the preferred embodiment.
Figure 11:
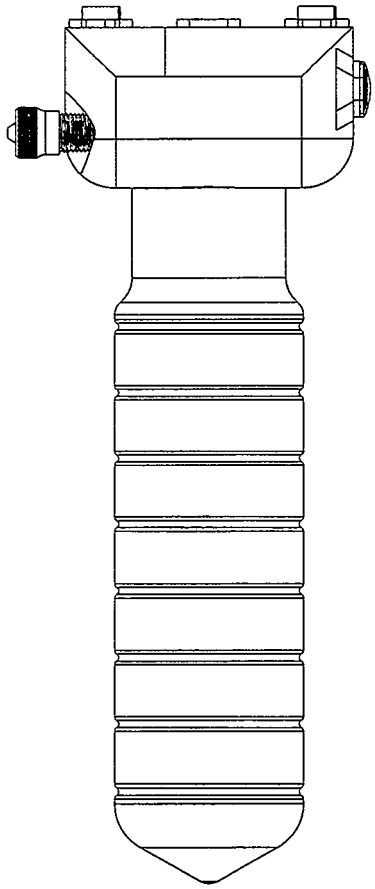
FIG. 11 is a left side view of the refillable vertical foregrip spray device in the preferred embodiment.
Figure 12:
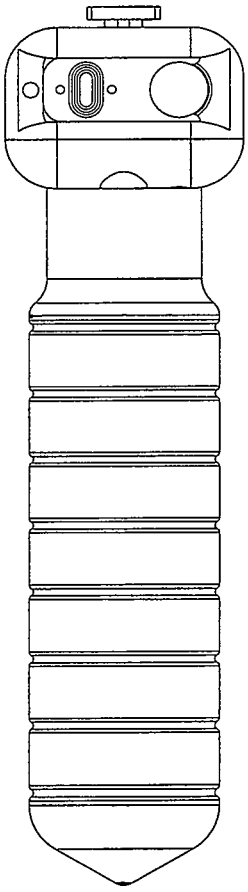
FIG. 12 is a rear view of the refillable vertical foregrip spray device in the preferred embodiment.
Figure 13:
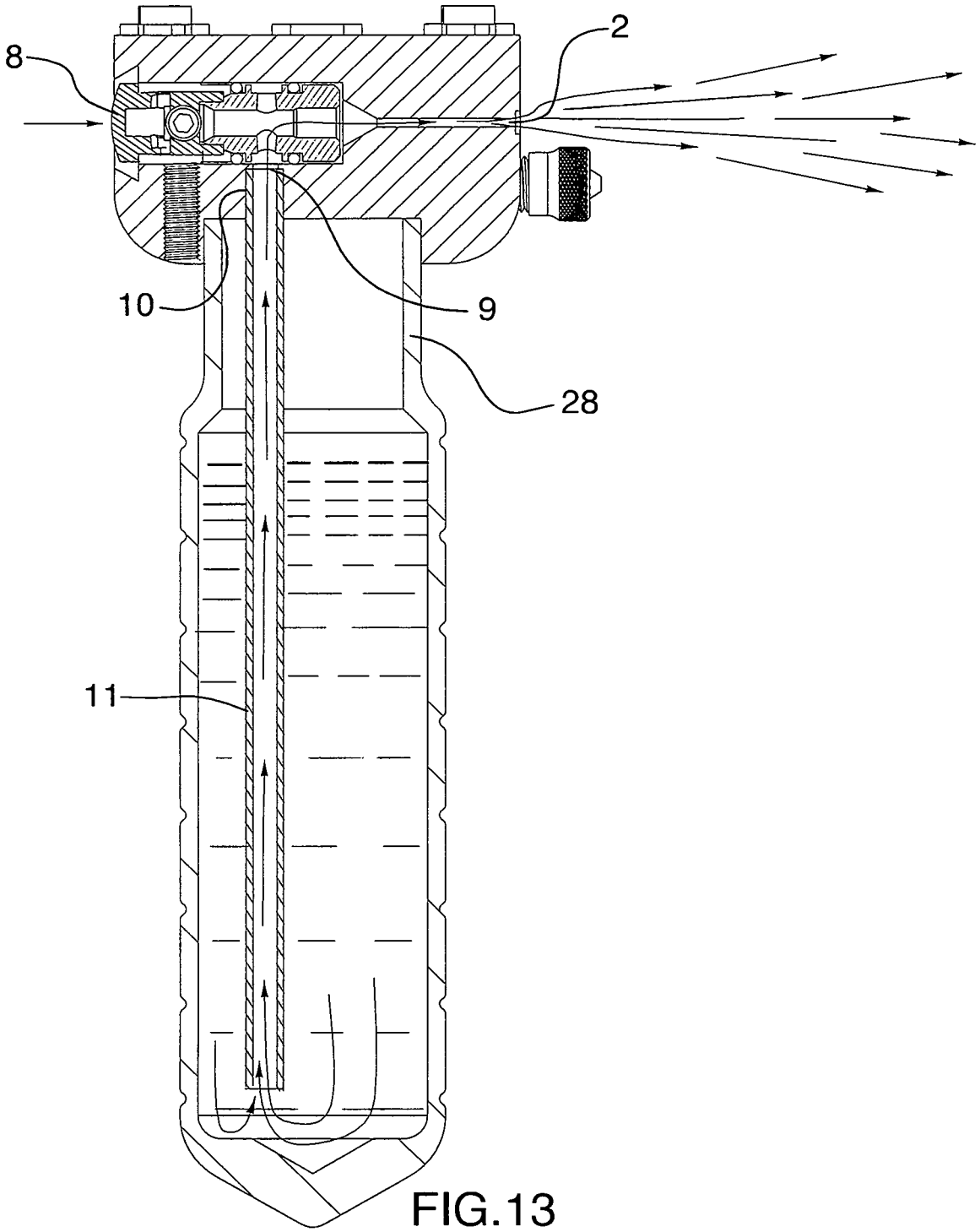
FIG. 13 is a cross sectional partial view of the refillable vertical foregrip spray device in the preferred embodiment.
Figure 14:
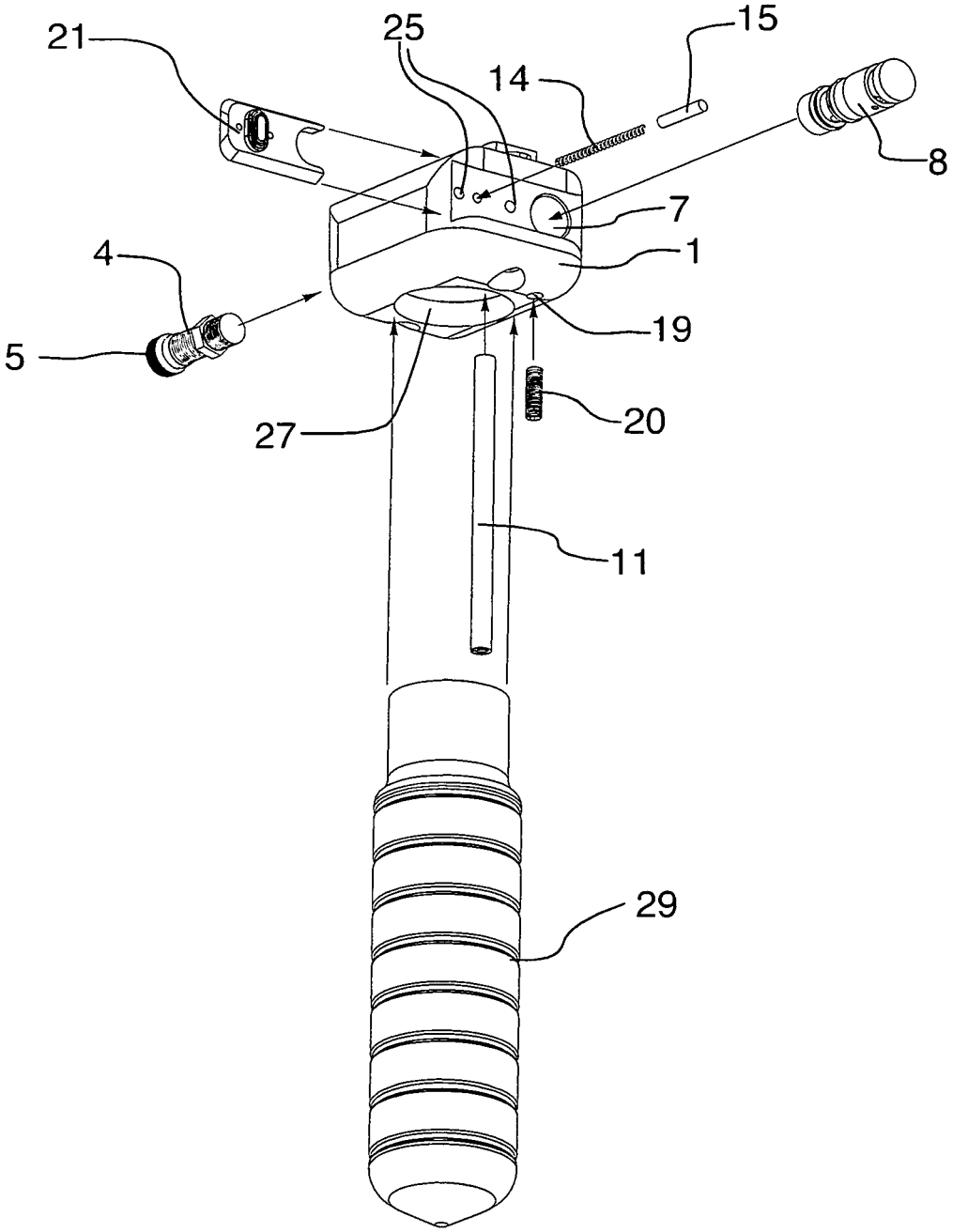
FIG. 14 is an exploded view of the refillable vertical foregrip spray device in the preferred embodiment.
Figure 15:
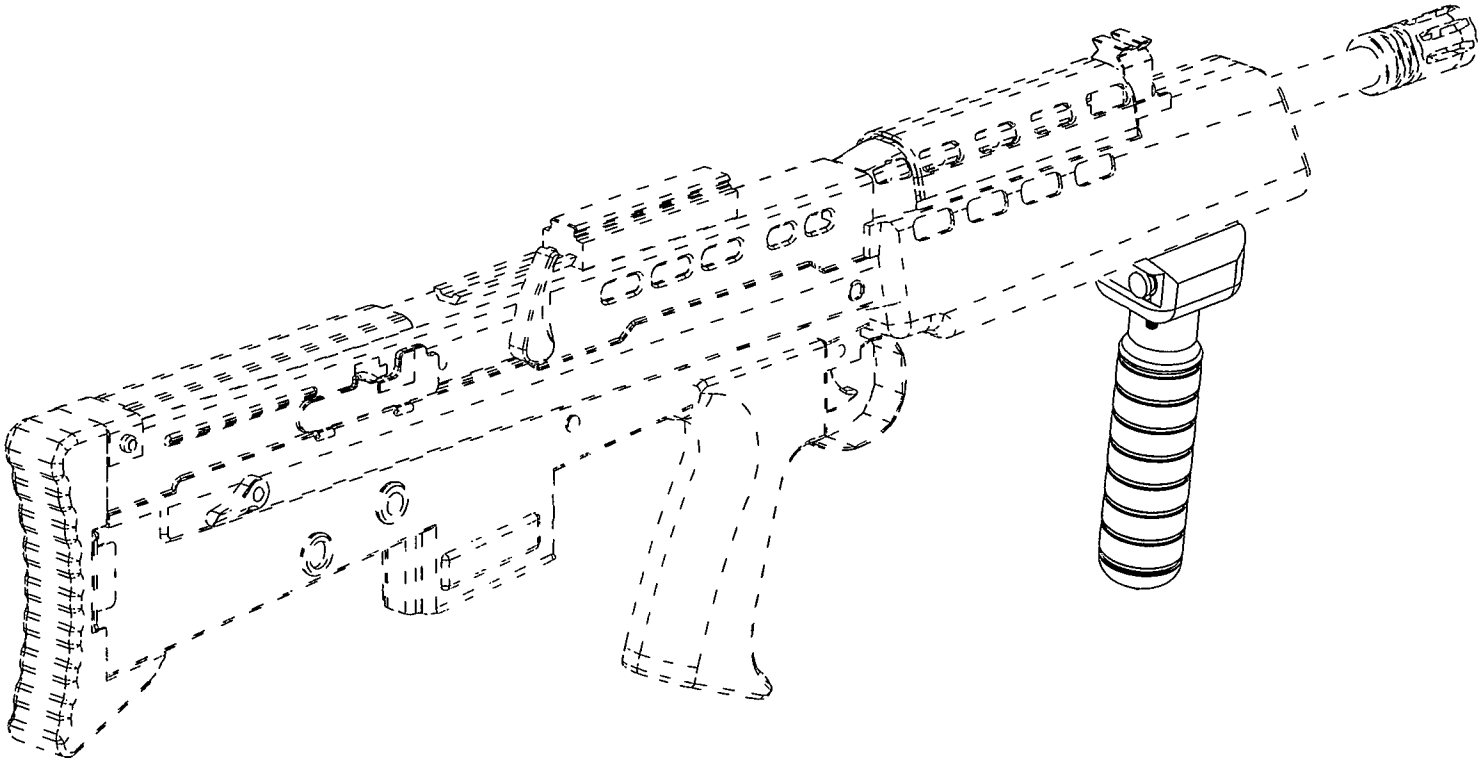
FIG. 15 is the preferred embodiment on a rifle.
Figure 16:
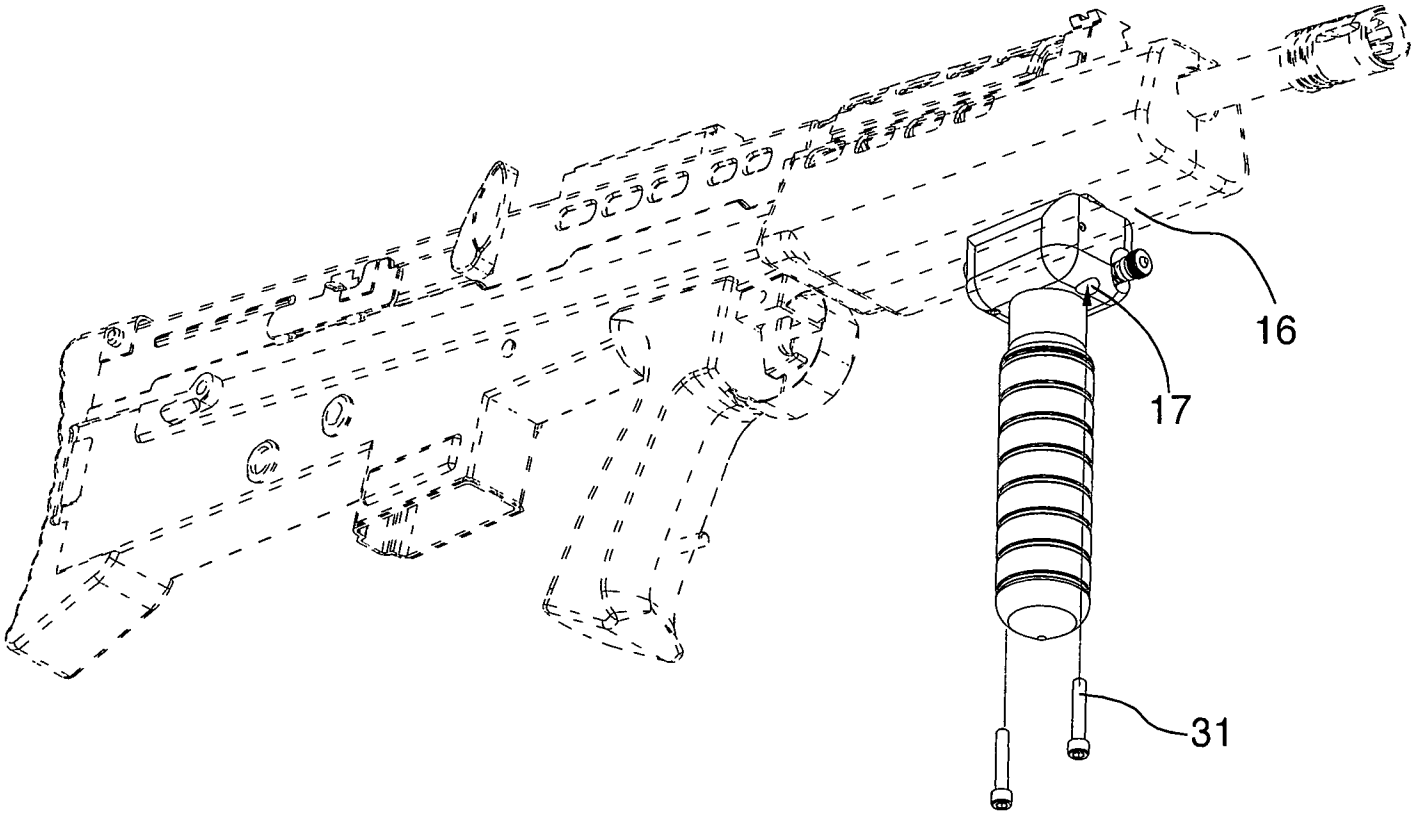
FIG. 16 is the preferred embodiment on a rifle.
Figure 17:
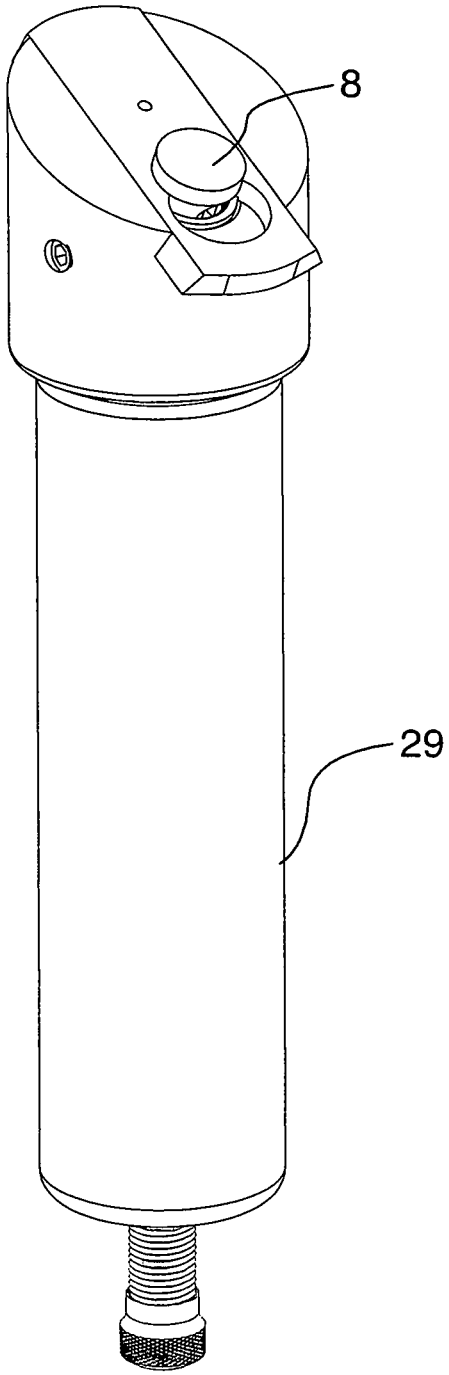
FIG. 17 is a side/rear view of another preferred embodiment.
Figure 18:
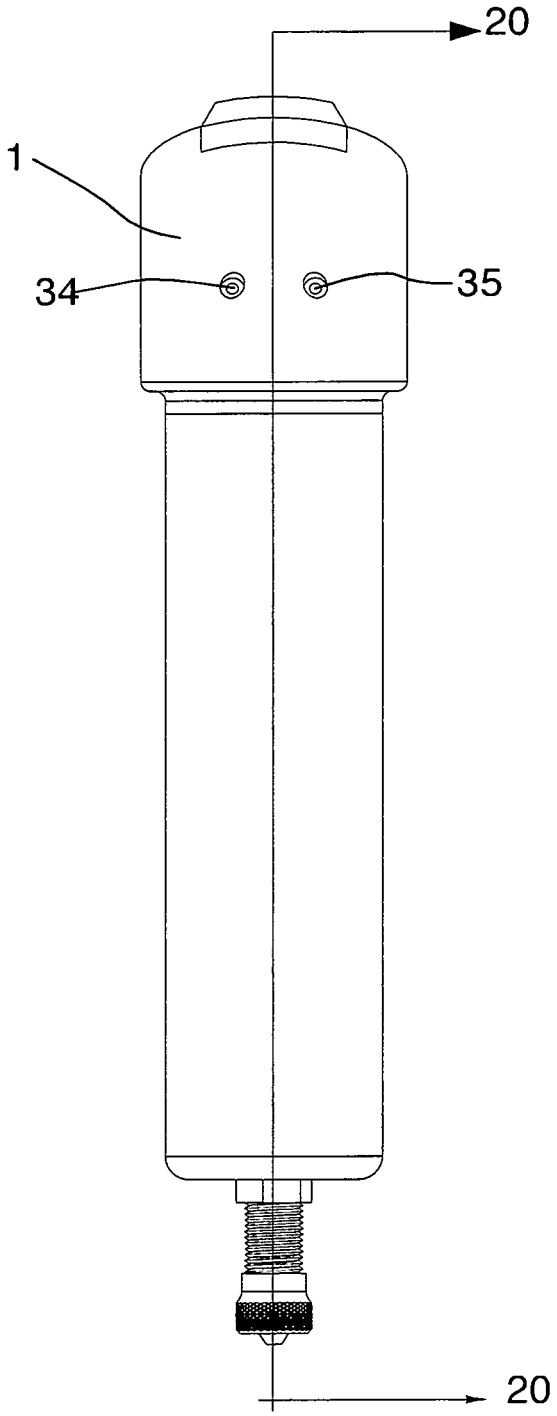
FIG. 18 is a front view of another preferred embodiment.
Figure 19:
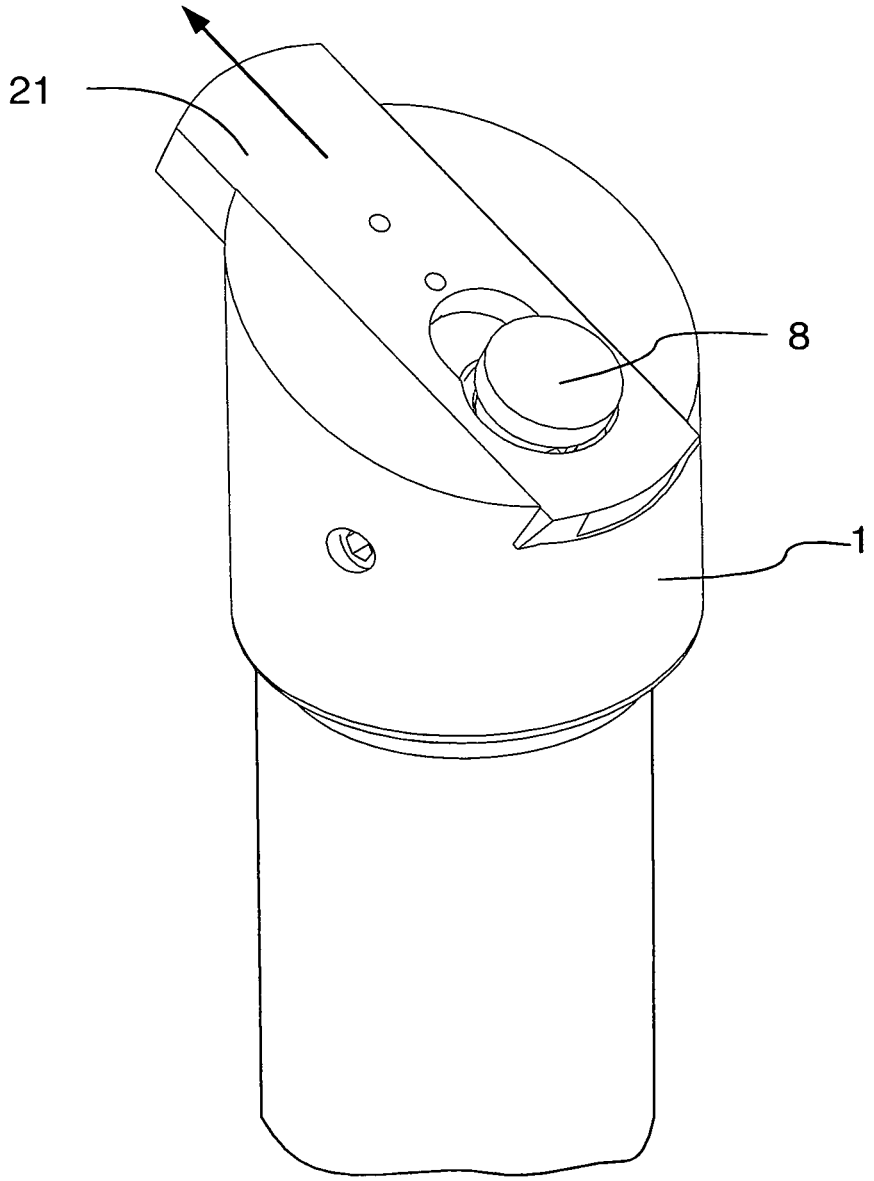
FIG. 19 is a side/rear view of another preferred embodiment.
Figure 20:
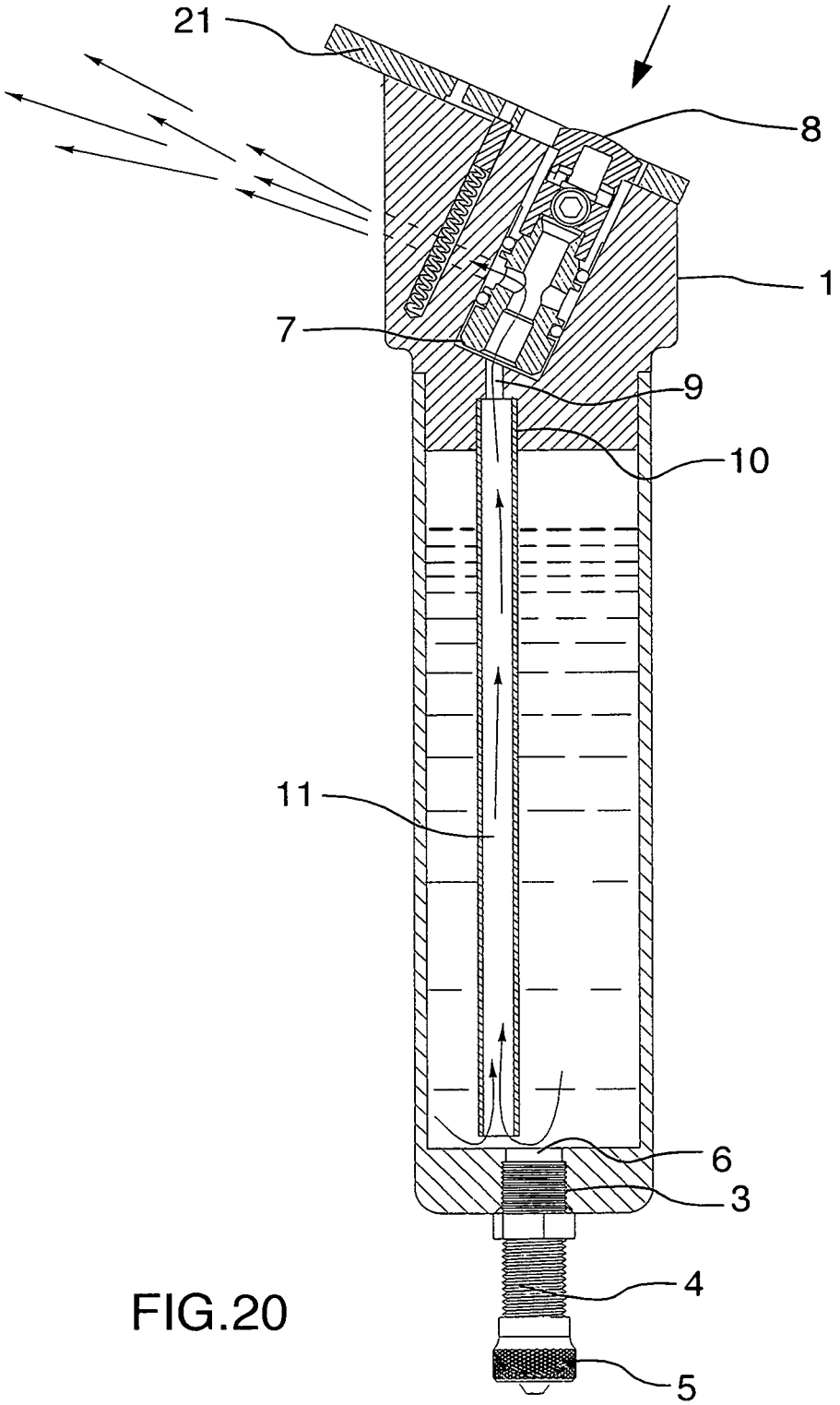
FIG. 20 is a cross sectional view of another preferred embodiment.
Figure 21:
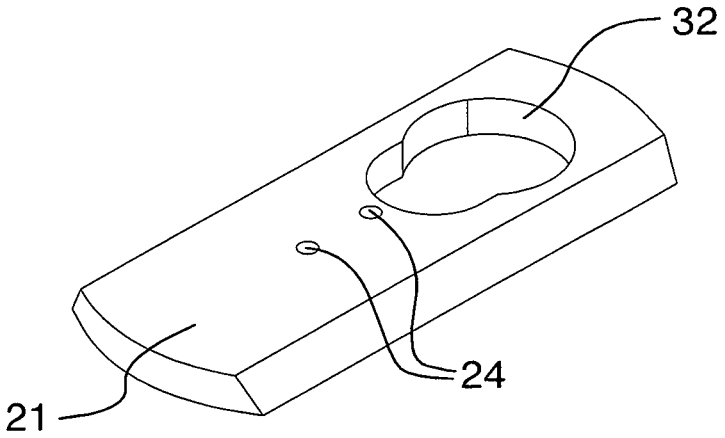
FIG. 21 is a top view of the sliding safety of another preferred embodiment.
Figure 22:
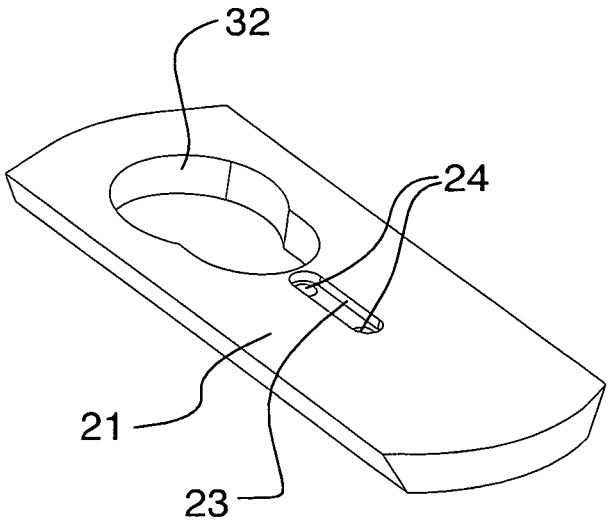
FIG. 22 is a rear view of the sliding safety of another preferred embodiment.
Figure 23:
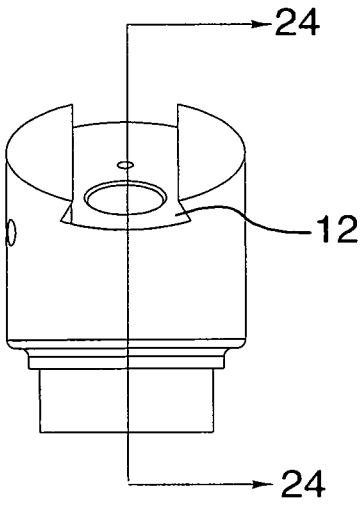
FIG. 23 is a rear view of the valve block of another preferred embodiment.
Figure 24:
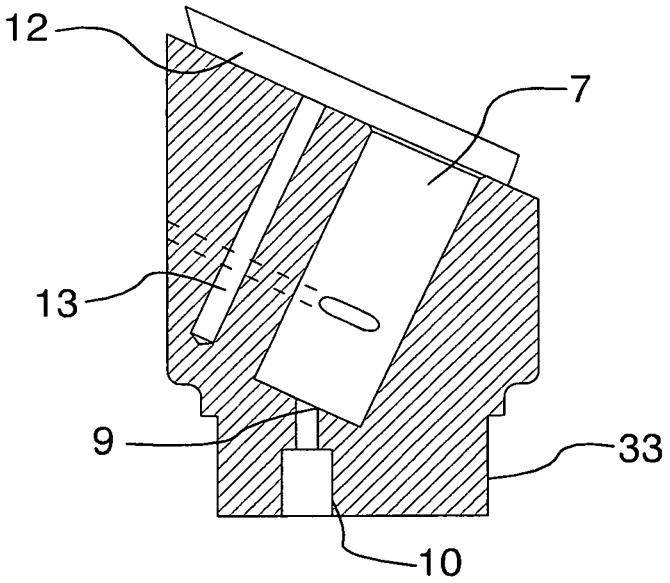
FIG. 24 is a cross sectional view of the valve block of another preferred embodiment.
Figure 25:
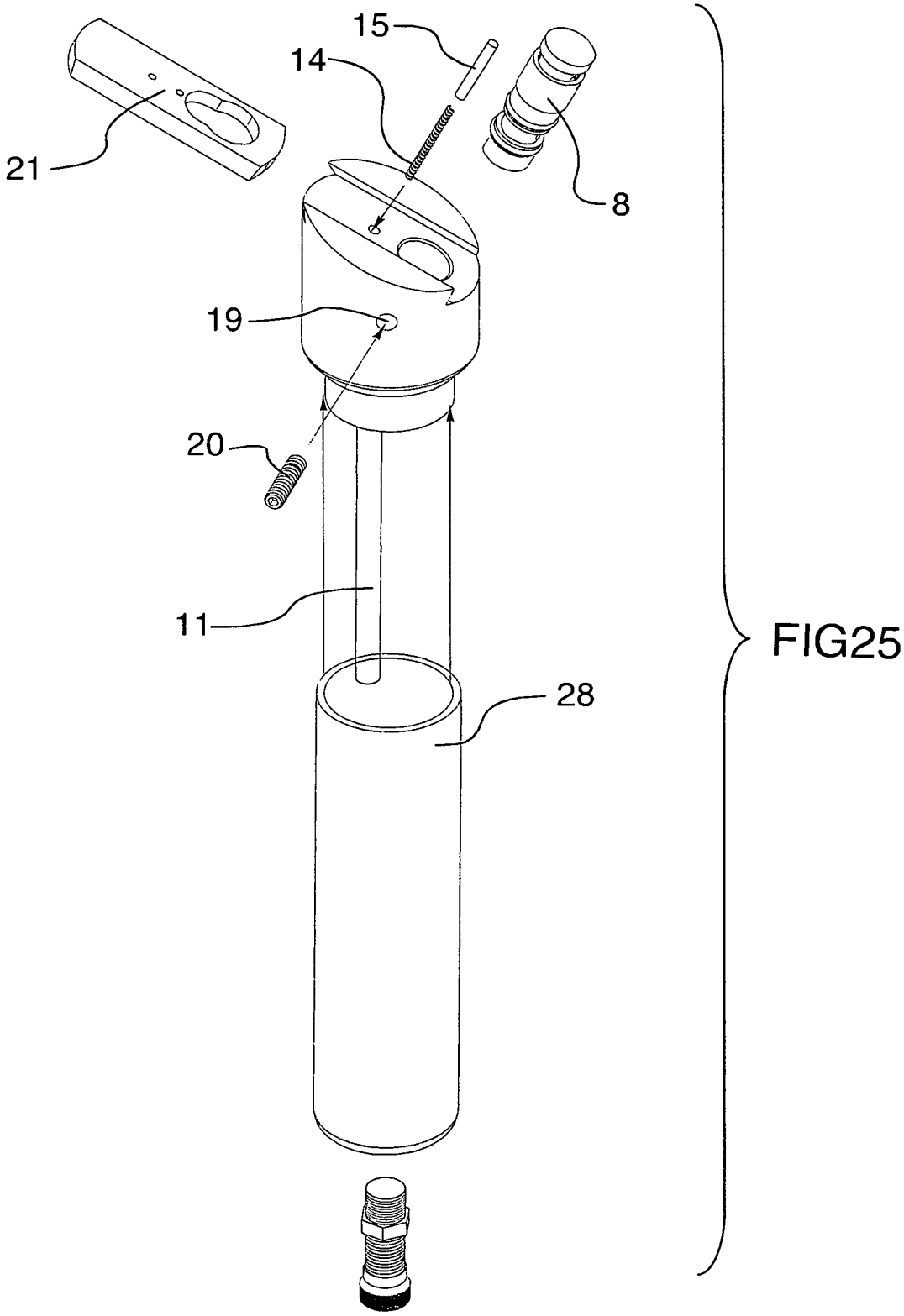
FIG. 25 is an exploded view of another preferred embodiment.

The invention claimed is:

1. Refillable vertical foregrip spray device comprising;

a) a valve block housing a push button release valve, a nozzle for directing pressurized contents, a sliding safety, a charge valve, a plurality of mating cavities, a plurality of internal conduits, a pickup tube, and an integral weapon mounting interface, b) a hollow cylindrical portion capable of withstanding a pressure and holding the liquid or gaseous contents to be dispensed, and an upper section able to mate with the valve block; wherein the sliding safety engages with the push button release valve of said device and wherein the sliding safety is retained by a dovetail, spring, and detent.

2. The refillable vertical foregrip spray device as recited in claim 1, further wherein the plurality of mating cavities includes a charge valve mating cavity to allow filling and internal pressurization of said device.

3. The refillable vertical foregrip spray device as recited in claim 1, wherein said plurality of internal conduits to allow pressurization and release of contents of said device.

4. The refillable vertical foregrip spray device as recited in claim 1, wherein the pickup tube is capable of drawing the contents from the bottom of the hollow cylindrical portion in said device.

5. The refillable vertical foregrip spray device as recited in claim 1, wherein the hollow cylindrical portion allows the user to securely grip and operate the assembled device.

6. The refillable vertical foregrip spray device as recited in claim 1, wherein the plurality of mating cavities allows the hollow cylindrical portion to connect to the valve block and the pickup tube to connect to its associated internal conduit.

* * * * *